US006196488B1

(12) United States Patent
Sakata et al.

(10) Patent No.: US 6,196,488 B1
(45) Date of Patent: Mar. 6, 2001

(54) SOUND-ABSORBING MATERIAL AND A CABLE REEL INCLUDING THE SAME

(75) Inventors: Tomoyuki Sakata, Nagoya; Tetsuya Iizuka; Akihito Maegawa, both of Yokkaichi, all of (JP)

(73) Assignees: Sumitomo Wiring Systems, Ltd.; Harness System Technologies Research, Ltd.; Sumitomo Electric Industries, Ltd., all of (JP)

( * ) Notice: Subject to any disclaimer, the term of this patent is extended or adjusted under 35 U.S.C. 154(b) by 0 days.

(21) Appl. No.: 09/136,743

(22) Filed: Aug. 19, 1998

(30) Foreign Application Priority Data

Aug. 20, 1997 (JP) ..... 9-223884

(51) Int. Cl.[7] ..... B65H 75/38; H01R 39/00; E04B 1/82; E04B 1/84

(52) U.S. Cl. ..... 242/388; 439/15; 439/164; 181/286; 181/290; 181/294

(58) Field of Search ..... 242/388, 402, 242/398; 439/15, 164; 428/172, 182; 181/290, 294, 286

(56) References Cited

U.S. PATENT DOCUMENTS 1,925,453 * 9/1933 Mazer .
2,069,413 * 2/1937 Leadbetter .
2,419,971 * 5/1947 Rumpf et al. .
2,973,295 * 2/1961 Rodgers, Jr. .
3,176,789 * 4/1965 Lighter .
4,441,581 * 4/1984 Sommerhalder .
4,921,428 * 5/1990 Sasaki et al. .
5,014,815 * 5/1991 Arcas et al. .
5,674,082 * 10/1997 Okuhara et al. .
5,707,023 * 1/1998 Ichikawa et al. .
5,945,643 * 8/1999 Casser .

FOREIGN PATENT DOCUMENTS

1044714 * 4/1996 (JP) .

* cited by examiner

*Primary Examiner*—Donald P. Walsh
*Assistant Examiner*—William A. Rivera
(74) *Attorney, Agent, or Firm*—Bierman, Muserlian and Lucas

(57) ABSTRACT

A sound-absorbing material and a cable reel including the same are produced inexpensively and are able to attenuate sliding noise and vibration noise. A sound-absorbing material 20 is made of a polyethylene film 20*a* and is formed into a thin waved sheet having continuous wave crests and wave troughs. A synthetic paper 20*b* having a lubricative surface is attached to the wave crests on a front side of the polyethylene film 20*a* through an adhesive. As an air layer 21 is defined in a space surrounded by the wave crests and wave troughs, any sounds which are transmitted to the polyethylene film 20*a* collide on the wave crests and wave troughs thereby being effectively attenuated and absorbed. The sound-absorbing material 20 is struck on a bearing surface 12*a* of a stationary member 11 by way of an adhesive. A lateral lower edge of a flat cable 15 slides on the lubricative surface of the synthetic paper 20*b*, thereby suppressing generation of sliding noise. Vibration noise during an idling mode collides on the wave crests and wave troughs thereby being effectively attenuated and adsorbed.

1 Claim, 4 Drawing Sheets

SOUND-ABSORBING MATERIAL AND A CABLE REEL INCLUDING THE SAME

BACKGROUND OF THE INVENTION

This invention relates to a sound-absorbing material and a cable reel including the same, and more particularly to a sound-absorbing material preferably adapted to be used in a cable reel which is mounted on a steering device for an automotive vehicle and electrically interconnects a stationary member assembly and a movable member assembly through a flat cable.

In an automotive vehicle equipped with an air bag, a cable reel is provided in a steering wheel in order to supply electrical power to an air bag system. For convenience of explanation, such a cable reel will be described below by referring to the drawings. FIGS. 5A to 5C show an example of a conventional cable reel. FIG. 5A is a schematic longitudinal sectional view of a conventional cable reel. FIG. 5B is a perspective view of a conventional sound-absorbing material. FIG. 5C is a fragmentary cross sectional view of the sound-absorbing material shown in FIG. 5B.

As shown in FIG. 5A, the conventional cable reel includes a movable member assembly 10 which rotates together with a steering wheel, and a stationary member assembly 11 which is secured to a stationary shaft on a body frame. The movable and stationary member assemblies 10 and 11 define an annular cable containing chamber 12 which accommodates a flat cable 15 in a coiled state. Opposite ends of the flat cable 15 in the coiled state are connected to lead wires which are led out from the movable and stationary member assemblies 10 and 11, respectively, to be connected to an external connector or electrical wires. In such a cable reel, the flat cable 15 is wound in the cable containing chamber 12 when the steering wheel is turned in either a clockwise or counter clockwise direction while the flat cable 15 is unwound in the chamber 12 when the steering wheel is turned in the other direction, so that a device (air bag) on the steering wheel is electrically connected to a power source on the body frame.

The cable reel involves a problem in that an unpleasant sliding noise is generated when the lateral opposite edges of the flat cable 15 slide on upper and lower bearing surfaces of the cable containing chamber 12 upon winding and unwinding of the flat cable 15 in the chamber 12. The flat cable 15 vibrates in an axial direction (from an upper to lower direction or from a lower to upper direction) of the steering wheel during idling or driving of the automotive vehicle, thereby giving rise to an unpleasant vibration noise due to collision between the bearing surfaces of the chamber 12 and the lateral opposite edges of the flat cable 15.

Japanese Utility Model Publication No. HEI 6-36040 (1994) discloses a cable reel in which a highly lubricative sheet such as a polytetrafluoroethylene (PTFE) resin or the like is stuck on at least one of bearing surfaces of a cable containing chamber in order to attenuate sliding noise. Also, Japanese Patent Public Disclosure No. HEI 8-104471 (1996) discloses a cable reel in which a sound-absorbing material made of a resilient material such as a rubber or the like or a sound-absorbing material with the polytetrafluoroethylene (PTFE) resin is attached to bearing surfaces of stationary and movable member assemblies by means of clamps provided on the surfaces.

A polytetrafluoroethylene resin sheet is stuck by way of PET (polyethylene telephthalate) on a surface of a rubber sheet since the former lacks adhesion to the latter.

Although the polytetrafluoroethylene resin sheet disclosed in Japanese Utility Model Publication No. HEI 6-36040 (1994) can attenuate the sliding noise on account of its high lubrication, it cannot reduce noise which is caused by collision of the flat cable with the bearing surfaces of the cable reel due to axial vibrations of the cable in a coiled state. In particular, such collision noise is likely to be accentuated when an engine is idling. On the other hand, the resilient sheet disclosed in Japanese Patent Public Disclosure No. HEI 8-104471 (1996) hardly attenuate sliding noise, since the lubrication between the flat cable and the resilient sheet is poor, although the sheet can reduce the collision or vibration noise.

In a sound-absorbing material 50 shown in FIG. 5C, a rubber sheet 50*a* having a polytetrafluoroethylene (PTFE) resin sheet 50*c* provided thereon can attenuate and absorb sliding noise and vibration noise by means of a highly lubricative resin and rubber sheet.

As shown in FIG. 5C, however, the rubber sheet 50*a* cannot absorb vibration noise effectively, since the rubber sheet 50*a* is a flat single layer, and therefore the sound-absorbing material cannot obtain an effective sound-absorbing function.

Also, as shown in FIGS. 5A and 5B, a rubber sheet 50*a*, a polyethylene telephthalate (PET) film 50*b* and a polytetrafluoroethylene (PTFE) resin sheet 50*c* must be punched out into an annular shape adapted to be used, since the bearing surfaces of the cable containing chamber 12 is in an annular form. Consequently, this involves much loss of material. In particular, a total cost of the cable reel becomes high since the PTFE resin sheet is expensive.

In addition, the above sound-absorbing material involves high costs due to an increase in working steps, since the PET film 50*b* is stuck to the rubber sheet 50*a* using an adhesive and then the PTFE resin sheet 50*c* is attached to the PET film 50*b* using an adhesive.

Moreover, the above sound-absorbing material gives rise to a problem in that it reduces a sound-absorbing effect since the hard PET film 50*b* is interposed between the rubber sheet 50*a* having a sound-absorbing function and the PTFE resin sheet 50*c* having a lubricative function. It is difficult to produce the PTFE resin sheet 50*c* having a low thickness since it is produced by means of skiving. Consequently, the sheet 50*c* on the market is usually more than 20 $\mu$m. Such a thick PTFE resin sheet 50*c* in addition to the hard PET film 50*b* will lower the sound-absorbing function.

SUMMARY OF THE INVENTION

An object of the present invention is to provide a sound-absorbing material and a cable reel including the same which can effectively attenuate both sliding noise and vibration noise and can be produced inexpensively.

In order to achieve the above object, a sound-absorbing material in accordance with the present invention is characterized in that: the sound-absorbing material is made of a resin film; the resin film is formed into a thin waved sheet having continuous wave crests and troughs by bending the resin film at a fine pitch; and a distance between a top of each wave crest and a bottom of each wave trough is set to be small so as to make a virtual thickness of the sheet thin.

In the above sound-absorbing material, an air layer is defined in a space surrounded by the wave crests and the wave troughs. Sliding noise and vibration noise can be efficiently attenuated when the sound waves generated by the noise collide with crests or troughs in the said material.

The resin film may be a polyethylene film or a polytetrafluoroethylene resin film. The film has a lubricative surface. As a high lubricative function can be obtained by the polytetrafluoroethylene resin film, the sliding noise can be more effectively attenuated.

A thin synthetic paper having a lubricative surface may be attached on the wave crests to be set as a bearing side.

The synthetic paper is produced from a main material made of a synthetic resin (e.g., a main material of a polyethylene resin and a mixture of an inorganic filling material and a little additive) while forming a number of microvoids (fine cavities) and laminating a smooth surface layer on a formed base layer by means of the biaxial extension film forming method (Tradename: YUPO).

The synthetic paper has the same superior lubricity as a conventional polytetrafluoroethylene resin sheet and is cheaper than the polytetrafluoroethylene resin sheet. This results in cost-down.

In the prior art, in order to make a surface of the rubber material lubricative, the polytetrafluoroethylene resin is formed into a sheet beforehand and the resin sheet is stuck on a rubber sheet through the hard PET film or the like since it is difficult to stick the resin sheet on the rubber sheet using an adhesive. Such a hard PET film on the rubber sheet lowers a sound-absorbing effect of the rubber sheet. On the other hand, each resin film is stuck on the respective wave crests and wave troughs continuously in the sound-absorbing material of the present invention. Lubricity of a surface can be obtained by the resin film itself or the synthetic paper attached on the resin film. The synthetic paper can be easily stuck on the resin film by way of an adhesive.

Consequently, since the sound-absorbing material of the present invention requires a PET film which is used to stick a resin sheet to a rubber sheet in the prior art, the synthetic paper does not interfere with a sound-absorbing action and can enhance the sound-absorbing effect. Moreover, the sound-absorbing material of the present invention can eliminate conventional steps for sticking the PET film to the resilient sheet and for sticking the polytetrafluoroethylene resin sheet to the PET film, thereby greatly reducing the working processes and the cost.

Preferably a polyethylene telephthalate (PET) sheet is stuck on the wave troughs to be set as an attaching side. This results in an increase of an adhesive area of the resin film for a support element and in enhancement of stiffness of the resin sheet.

A cable reel having a sound-absorbing material in accordance with the present invention comprises a stationary member assembly and a movable member assembly rotatably mounted on the stationary member assembly. The stationary and movable member assemblies define a cable containing chamber having an annular configuration and upper and lower bearing surfaces. The cable containing chamber accommodating a flat cable in a coiled state between the upper and lower bearing surfaces. The opposite ends of the flat cable are led out from the stationary and movable member assemblies through electrical means. The resin film is formed into a thin waved sheet having continuous wave crests and troughs by bending the resin film at a fine pitch. A distance between a top of each wave crest and a bottom of each wave trough is set to be small so as to make a virtual thickness of the sheet thin. The sound-absorbing material is stuck on at least the lower bearing surface of the cable containing chamber so that the flat cable slides on the sound-absorbing material.

The sound-absorbing material is formed into an annular shape corresponding to the annular shape of the bearing surface of the cable containing chamber to be adapted to adhere to a whole area of the bearing surface.

The cable reel described above is attached to a steering device of an automotive vehicle to supply electrical power to an air bag system. When the movable member assembly which rotates with a steering wheel is turned to one direction, the flat cable is wound in the cable containing chamber in the cable reel while the flat cable is unwound when the assembly is turned in the other direction. The lateral opposite edges of the flat cable, in particular, the lateral lower edge which is subject to an empty weight, slide on the bearing surfaces of the cable containing chamber, in particular the lower bearing surface during rotary motion. Since the synthetic paper having a superior lubricity is attached to the resilient base element of the sound-absorbing material on the bearing surface, the flat cable can rotate smoothly in the cable containing chamber, thereby suppressing generation of sliding noise. In other words, the flat cable slides on the lubricative synthetic paper stuck on the wave crests of the resin film having a lubricative surface, thereby suppressing generation of sliding noise. At that time, a contact area between the lateral lower edge of the flat cable and the wave crests of the resin film becomes smaller. This results in a decrease of sliding noise and contact friction.

Also, even if the flat cable vibrates in the axial direction of the cable reel due to vibration of the engine during an idling mode or a driving mode and the lateral lower edge of the flat cable collides on the lower bearing surface of the cable containing chamber, unpleasant vibration noise is absorbed by collision of the noise onto the wave crests and troughs.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DETAILED DESCRIPTION OF THE PREFERRED EMBODIMENTS

Figure 5A:
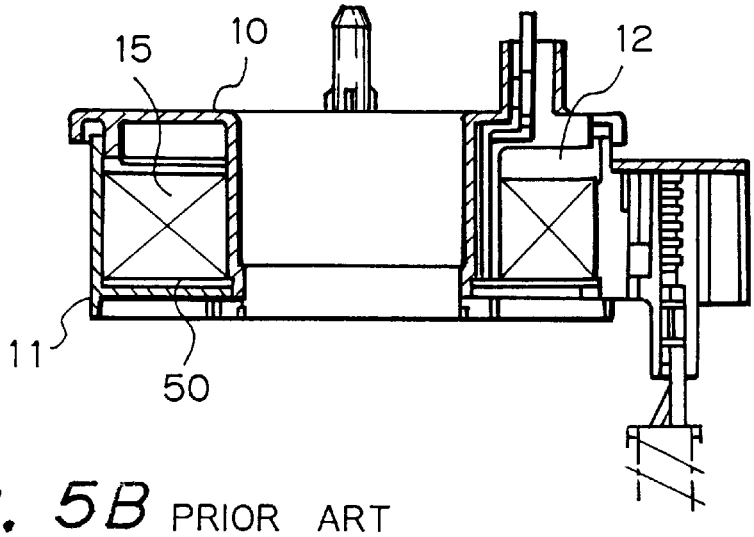
Fig. 5A PRIOR ART
FIG. 5A is a schematic longitudinal sectional view of a conventional cable reel.
Figure 5B:
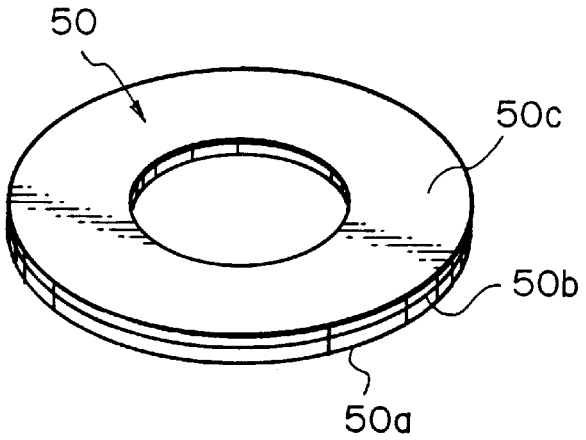
Fig. 5B PRIOR ART
FIG. 5B is a perspective view of the conventional sound-absorbing material.
Figure 5C:
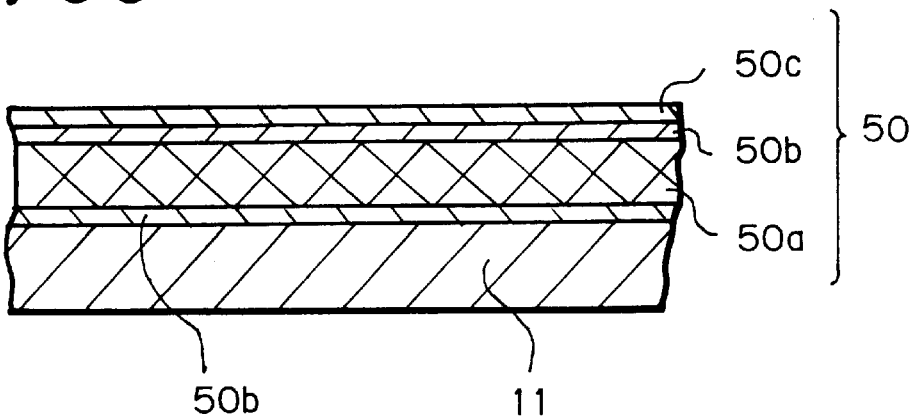
Fig. 5C PRIOR ART
FIG. 5C is a fragmentary enlarged cross sectional view of the conventional sound-absorbing material.

Embodiments of the present invention will be described below by referring to the drawings. The embodiments are directed to a cable reel which includes a sound-absorbing material and is mounted on a steering device in an automotive vehicle. A main body of the cable reel of the present invention has the same structure as that of the conventional cable reel shown in FIG. 5A. In both structures, the same members are indicated by the same reference numbers.

The cable reel of the present invention includes a movable member assembly 10 which is secured to a steering wheel (not shown) to be turned together with it, and a stationary member assembly 11 which is secured to a shaft (not shown) fixed on a body frame. The movable member assembly 10 has an upper wall 10*a* and an inner peripheral wall 10*b* while the stationary member assembly 11 has a lower wall 11*a* and an outer peripheral wall 11*b*. The movable and stationary member assemblies 10 and 11 define an annular cable containing chamber 12. The cable containing chamber 12 accommodates a flat cable 15 in a coiled state. An inner end of the flat cable 15 in a coiled state is connected to a lead wire 13 which is led out through an attaching hole 10*c* in the upper wall 10*a* of the movable member assembly 10. An outer end of the flat cable 15 in a coiled state is connected to a lead wire 14 which is led out from the stationary member assembly 11. The flat cable 15 is wound in the cable containing chamber 12 when the steering wheel is turned in one direction while the flat cable 15 is unwound in the chamber 12 when the steering wheel is turned in the other direction. Thus, the lead wires 13 and 14 are electrically coupled to each other through the flat cable 15, even if the steering wheel is turned to either direction.

Figure 1:
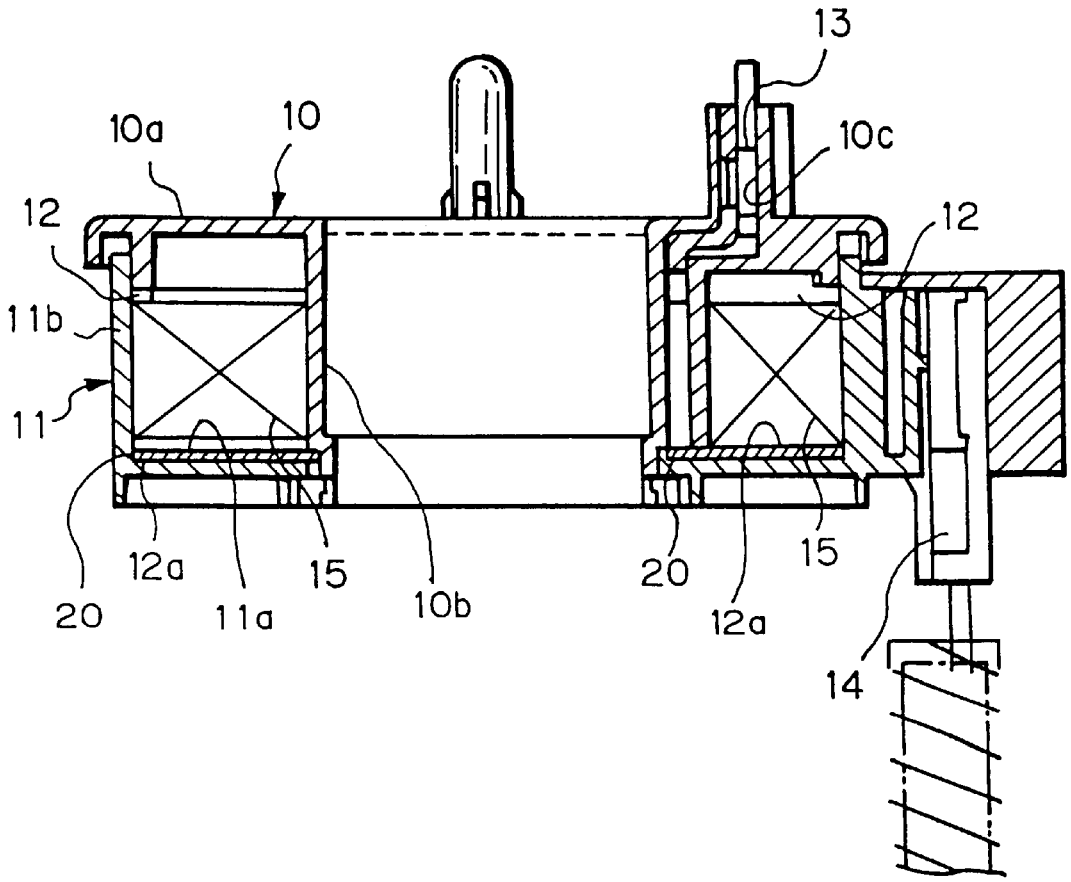
FIG. 1 is a schematic longitudinal sectional view of a cable reel in accordance with the present invention.
Figure 2:
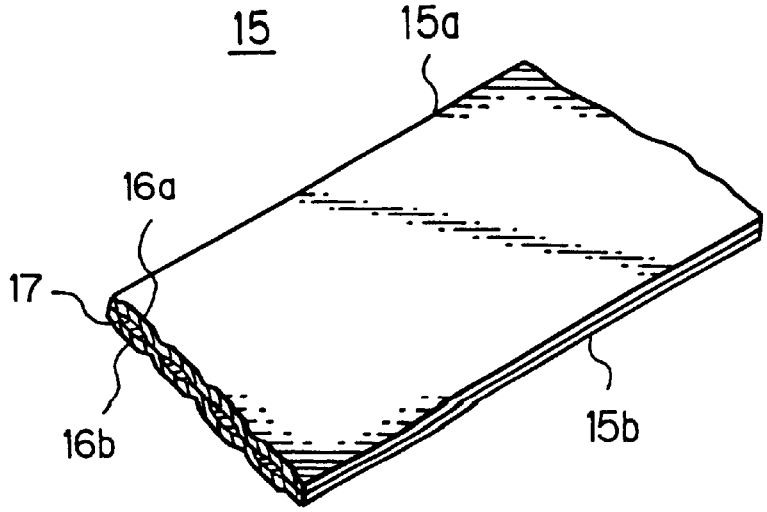
FIG. 2 is a schematic perspective view of a part of a flat cable to be accommodated in a cable containing chamber of the cable reel shown in FIG. 1.
Figure 3:
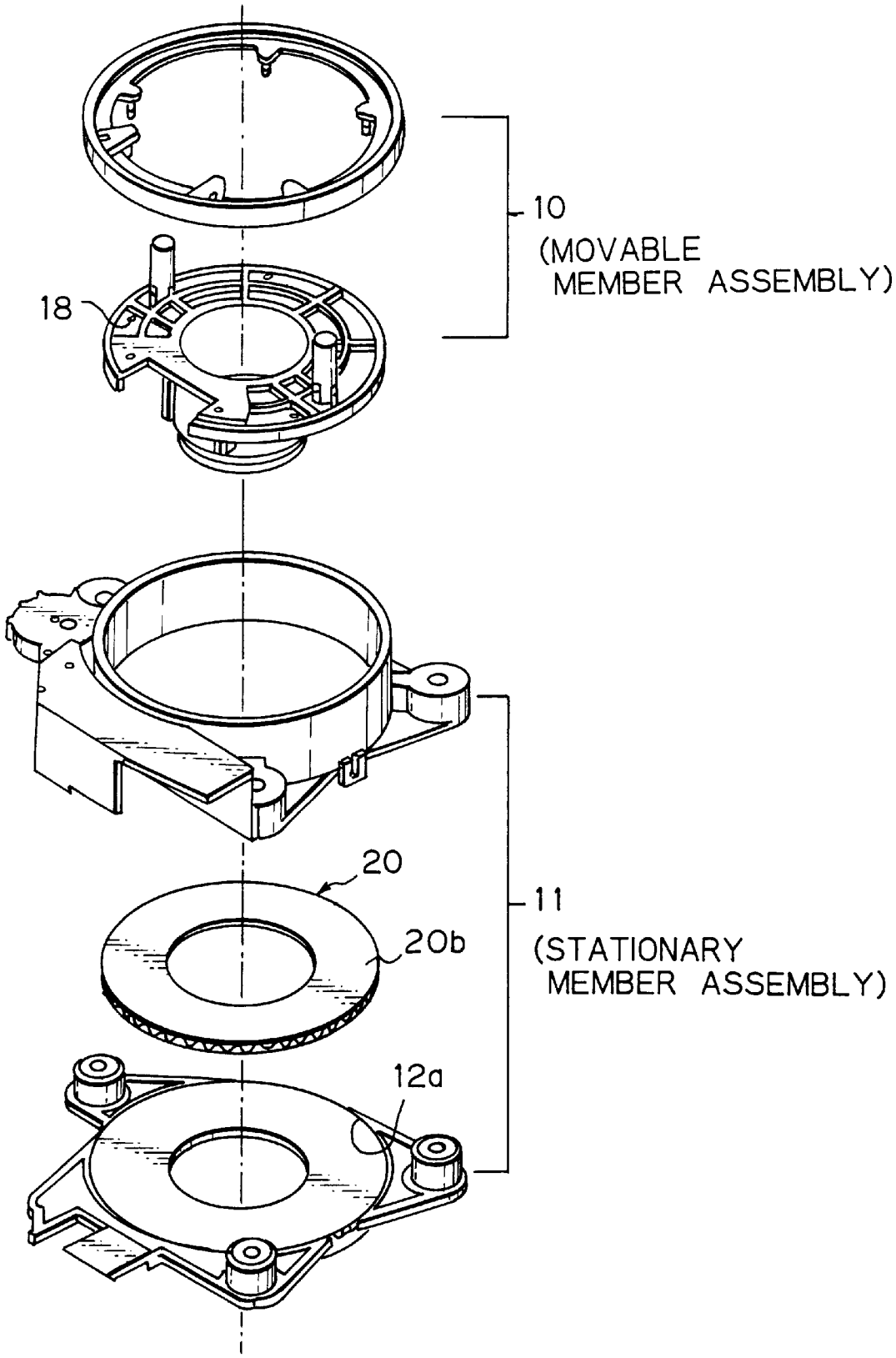
FIG. 3 is an exploded perspective view of the cable reel shown in FIG. 1, illustrating main elements constituting the cable reel.

The flat cable 15, as shown in FIG. 2, includes a pair of insulation resin films 16*a* and 16*b*, and a conductive material 17 interposed between the films 16*a* and 16*b*. The flat cable 15 is wound and unwound in the cable containing chamber 12 while either one of lateral opposite edges 15*a* and 15*b* of the flat cable 15 is sliding on a lower annular flat bearing surface 12*a* of the cable containing chamber 12. Accordingly, a sound-absorbing material 20 is mounted on the lower bearing surface 12*a*, as shown in FIG. 3.

On the other hand, the cable containing chamber 12 is provided on the upper wall with a plurality of elongate ribs 18 each of which extends radially and is spaced apart at a given distance in the circumferential direction. There is a slightly small clearance between the ribs 18 and the lateral upper edge 15*a* of the flat cable 15. Thus, no sliding noise is generated on the upper side in the cable containing chamber 12. The sound-absorbing material 20 may be mounted on the upper flat annular wall of the cable containing chamber 12 without providing the ribs 18 on the wall.

A first embodiment of the sound-absorbing material 20 has an annular shape corresponding to the annular shape of the lower bearing surface 12*a* of the stationary member assembly 11.

Figure 4A:
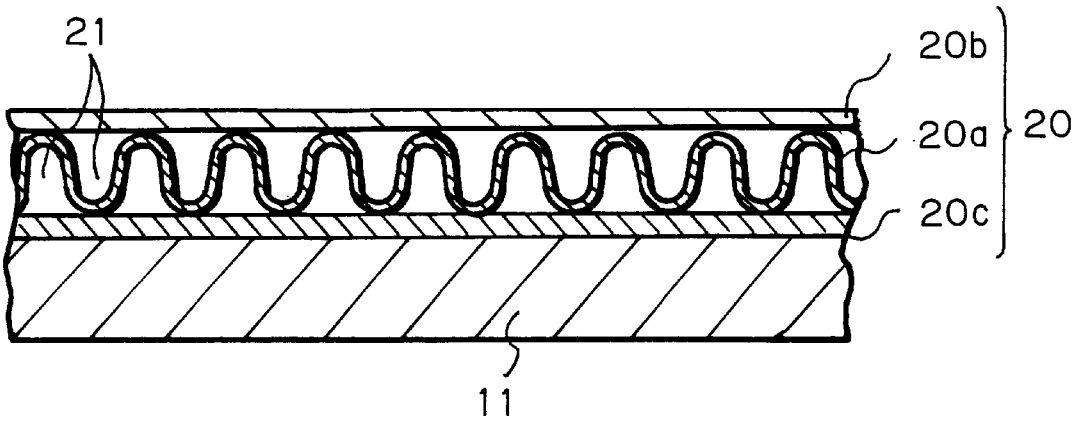
FIG. 4A is a fragmentary enlarged cross sectional view of an embodiment of a sound-absorbing material in accordance with the present invention, illustrating the sound-absorbing material attached to a stationary member assembly.
Figure 4B:
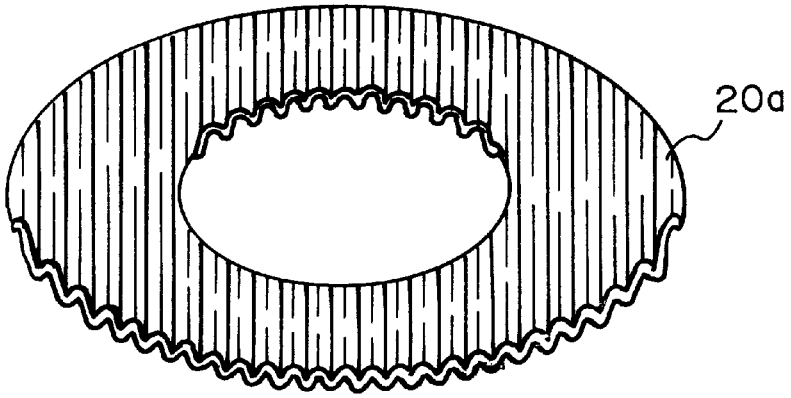
FIG. 4B is an enlarged perspective view of a part of the sound-absorbing material shown in FIG. 4A.

The sound-absorbing material 20, as shown in FIG. 4, is formed into a thin waved sheet having continuous wave crests and troughs by bending a polyethylene film 20*a* at a fine pitch. A distance between a top of each wave crest and a bottom of each wave trough is set to be small so as to make a virtual thickness of the sheet thin.

A synthetic paper 20*b* is stuck on the wave crests of the polyethylene film 20*a* at a front side of the film through an adhesive.

The synthetic paper 20*b* is produced from a main material made of a synthetic resin (e.g., a main material of a polypropylene resin and a mixture of an inorganic filling material and a little additive) while forming a number of microvoids (fine cavities) and laminating a smooth surface layer on a formed base layer by means of the biaxial extension film forming method (Tradename: YUPO). The synthetic paper 20*b* has a thickness of 80 $\mu$m. A PET (polyethylene telephthalate) film 20*c* is stuck on the wave troughs of the polyethylene film 20*a* at an attaching side onto the bearing surface 12*a* of the stationary member assembly 11. The PET film 20*c* can increase an adhesive area for the bearing surface 12*a* and give a suitable stiffness to the polyethylene film 20*a*. This makes it easy to attach the sound-absorbing material 20 to the bearing surface 12*a*.

Thus, an air layer 21 is formed in a space surrounded by the continuous wave crests and troughs. Any sounds which are transmitted to the polyethylene film 20*a* collide with the wave crests and troughs and are then attenuated and absorbed by them.

The synthetic paper 20*b* is provided on the surface with the synthetic paper 20*b* having a lubricative surface.

Heretofore, an expensive polytetrafluoroethylene resin sheet was stuck on a rubber material in order to give a lubricative surface to the rubber material. A hard PET film or the like, however, was disposed between the rubber material and the polytetrafluoroethylene resin sheet, since the resin sheet hardly adheres to the rubber material. The hard PET film will deteriorate the sound-absorbing action and effect.

On the other hand, since the sound-absorbing material 20 of the present invention uses the synthetic paper 20*b* which has good adherence, the material 20 requires no PET film. The synthetic paper 20*b* does not cause any deterioration in the sound-absorbing effect. Moreover, the synthetic paper 20*b* can eliminate conventional steps for sticking the PET film on the resilient sheet and for sticking the polytetrafluoro-ethylene resin sheet on the PET film, thereby greatly reducing the working processes and cost.

The sound-absorbing material 20 constructed above is secured to a lower bearing surface 12*a* of the stationary member assembly 11 by an adhesive. A lateral lower edge of the flat cable 15 slides on the synthetic paper 20*b*, thereby attenuating sliding noise.

When the flat cable 15 vibrates axially and collides on the lower sound-absorbing material 20 to generate tapping noise during an idling mode or a driving mode, the wave crests and troughs of the polyethylene film 20*a* attenuate and absorb tapping noise effectively.

Consequently, the sound-absorbing material 20 can reduce sliding noise as well as vibration noise generated by the flat cable 15.

Although the synthetic paper 20*b* is attached to each of the front and rear sides of the sound-absorbing material 20 in the above embodiment, the wave crests of the resin film may directly receive the flat cable 15 without using the synthetic paper 20*b* to suppress sliding noise. At that time, a contact area between the lateral lower edge of the flat cable 15 and the wave crests becomes small, thereby reducing sliding noise and contact friction.

Although the polyethylene film is used as a base element of the sound-absorbing material in the above embodiment, the polytetrafluoroethylene resin film may be used as the base element in place of the polyethylene film. In this case, lubricity of the wave crests becomes higher.

It should be noted that the cable reel of the present invention is not limited to a cable reel to be mounted on a steering device and can be applied to a similar device. It should be also noted that the sound-absorbing material of the present invention is not limited to the case where the material is attached to a bearing surface of the cable reel. The sound-absorbing material may be secured to a place where one member slides on a surface of the other member and both members are subject to vibration, in order to attenuate any noise.

It will be apparent from the foregoing that the sound-absorbing material according to the present invention is provided with an air layer in a space surrounded by the wave crests and troughs of the resin film. Sounds collide on the wave crests and troughs and are then attenuated effectively. Accordingly, the sound-absorbing material of the present invention can absorb sounds more efficiently than a conventional rubber sheet having a single layer.

When the above sound-absorbing material is applied to a cable reel, the wave crests of the resin film which has a lubricative surface or the lubricative synthetic paper can bear smoothly the lateral lower edge of the flat cable, thereby reducing sliding noise.

Even if a lateral lower edge of the flat cable collides with a lower bearing surface by axial vibration of the flat cable upon driving, vibration noise is effectively absorbed by the wave crests and troughs of the sound-absorbing material, thereby attenuating unpleasant vibration noise.

The sound-absorbing material of the present invention can attenuate both sliding noise and vibration noise efficiently and needs no PET film between the resin film and the synthetic paper. The PET film has interfered with the sound-absorbing action in the prior art. The synthetic paper is inexpensive and eliminates conventional steps for attaching the PET film to the resin film and for attaching the polytetrafluoroethylene resin sheet to the PET film, thereby reducing working processes and cost.

From the above description of the invention, those skilled in the art will perceive improvements, changes and modifications. Such improvements, changes and modifications within the skill of the art are intended to be covered by the appended claims.

The entire disclosure of Japanese Patent Application No. HEI 9-223884 (1997) filed on Aug. 20, 1997 including specification, claims, drawings and summary is incorporated herein by reference in its entirety.

What is claimed is:

1. The cable reel having a sound-absorbing material, comprising a stationary member assembly and a movable member assembly rotatably mounted on said stationary member assembly, said stationary and movable member assemblies defining a cable containing chamber having an annular configuration and upper bearing surface and a lower bearing surface, said cable containing chamber accommodating a coiled flat cable between said upper bearing surface and said lower bearing surface, opposite ends of said flat cable extending out from said stationary member assembly and said movable member assembly through electrical connections;

said sound-absorbing material being of a resin film; said resin film formed into a single waved sheet having continuous wave crests and troughs by bending said resin film at a pitch, said resin film being one selected from the group consisting of polyethylene film and polytetra fluoroethylene film; a distance between a top of each wave crest and a bottom of each wave trough is such that virtual thickness of said sheet is minimized, and said sound-absorbing material is attached to at least said lower bearing surface of said cable containing chamber so that said flat cable slides on said sound-absorbing material;

a single planar synthetic paper having a lubricative surface is adhered to said wave crests as a bearing side on which said cable slides; a single planar polyethylene terephthalate (PET) sheet is adhered to said wave troughs as an attaching side; and an air laver formed in a space around said crests and troughs of said waved sheet and between said synthetic paper and PET sheet.

* * * * *